United States Patent [19]

Graham et al.

[11] 4,179,858

[45] Dec. 25, 1979

[54] BUILDING STRUCTURE AND METHOD OF CONSTRUCTION

[76] Inventors: Douglas L. Graham, R. R. 2, Auburn, Ind. 46706; Mark L. Graham, 6912 Ludwig Cir., Fort Wayne, Ind. 46825

[21] Appl. No.: 785,875

[22] Filed: Apr. 8, 1977

[51] Int. Cl.[2] ..... E04B 1/00; E04B 7/00

[52] U.S. Cl. ..... 52/262; 52/227; 52/229; 52/378; 52/477; 52/479; 52/656; 52/744

[58] Field of Search ..... 52/227, 650, 464, 656, 52/479, 228, 229, 414, 744, 612, 477, 745, 380, 381, 379, 378, 576, 577, 410, 407, 577, 309.11, 309.7, 262; 264/45.8, 45.3, 46.7

[56] References Cited

U.S. PATENT DOCUMENTS

| | | | |
|---|---|---|---|
| 683,195 | 9/1901 | Beam | 52/227 X |
| 1,753,451 | 4/1930 | Tonnelier | 52/227 X |
| 2,781,657 | 2/1957 | Taylor | 52/227 |
| 3,030,737 | 4/1962 | Deming | 52/479 |
| 3,295,286 | 1/1967 | Schaich | 52/227 X |
| 3,305,991 | 2/1967 | Weismann | 52/612 X |
| 3,435,580 | 4/1969 | Merrill et al. | 52/576 X |
| 3,466,825 | 9/1969 | Guddal | 52/378 X |
| 3,512,329 | 5/1970 | Plessis | 52/715 X |
| 3,522,683 | 9/1970 | Wise | 52/378 |
| 3,530,631 | 9/1970 | Guddal | 52/414 |
| 3,559,355 | 2/1971 | Day, Jr. | 52/378 X |
| 3,879,908 | 4/1975 | Weismann | 52/577 X |

FOREIGN PATENT DOCUMENTS

| | | | |
|---|---|---|---|
| 481597 | 7/1952 | Canada | 52/612 |

*Primary Examiner*—Leslie Braun
*Attorney, Agent, or Firm*—David A. Lundy

[57] ABSTRACT

The invention is comprised of a plurality of parallel spaced-apart stud members with a plurality of blocks positioned between adjacent stud members. A plurality of straps are positioned around alternate stud members to form a lattice assembly. When the straps are tightened, the blocks are held within the lattice assembly. The entire lattice assembly is surfaced with a layer of concrete, plaster, or other suitable building material to provide a load bearing building structure. Providing that the surface material can withstand the abuses of weather, the building structure of the invention may be used for exterior walls and roofs. In a specific embodiment in which the blocks are of a foamed polystyrene insulating material the invention provides a better insulated building structure that conventional construction.

23 Claims, 10 Drawing Figures

BUILDING STRUCTURE AND METHOD OF CONSTRUCTION

BACKGROUND OF THE INVENTION

The field of the invention relates to building structures and methods of construction and more particularly, the field of the building structures and methods of construction comprising a lattice structure with interstitial material contained therein.

The prior art discloses modular building panels of plastic foam material reinforced by a lattice of light gauge rod or wire. The prior art also discloses a lattice having wall boards attached to both sides thereof, with the space therebetween filled with resin. The prior art also discloses a foamed plastic panel comprised of a plurality of spaced-flanges held in position by transversely connected wire. The space between the panels is filled with foam, and the entire exterior surface is plastic coated. None of these building structures are designed for on-site construction.

While modular building panels have certain advantages, one problem apparent with these prior art structures is that some lack the combination of strength and endurance necessary to withstand the rigors of weather. Others do not have strength necessary for a suitable load bearing wall structure.

In addition, many high strength plastics are expensive, and difficult to apply. Thus, most of the prior art modular building structures cannot be erected on site and be competitive with building structures of conventional building materials such as plaster, concrete and the like.

It is therefore highly desirable to provide a building structure having many of the advantages of modular building panels, with the requisite strength for load bearing walls and roofs and the endurance necessary to withstand the rigors of weather. It is also highly desirable to provide a method of constructing such a building structure on site.

With the advent of solar heating devices and the desire to conserve energy, it is highly desirable to provide an improved insulated building structure. The building structure of the invention provides a wall or roof structure which, when comprised of interstitial blocks of good insulating materials such as foamed polystyrene, has better insulating properties than wall and roof structures of conventional design.

SUMMARY OF THE INVENTION

It is therefore an object of the invention to provide an improved building method and structure.

It is another object of the invention to provide an improved building structure which is relatively inexpensive to assemble and a method for assemblying the same at the construction site.

It is another object of this invention to provide an improved building structure which can be used as a load bearing wall structure.

It is another object of this invention to provide an improved building structure which can be used as exterior walls or roofs.

It is another object of the invention to provide an improved building method and structure having many of the advantages of modular prefabricated construction and utilizing conventional building materials on the exposed surfaces thereof.

It is another object of this invention to provide an improved building structure and method of construction which fulfills all of the objects above mentioned and further provides walls and roofs having superior insulating qualities compared with walls and roofs constructed by conventional on site construction techniques.

Finally, it is an object of this invention to provide an improved building method and structure which fulfills all of the objects above-mentioned and yet provides a building structure which is relatively inexpensive to assemble at the construction site.

The invention in its broader aspects is a building structure comprised of a plurality of parallel, spaced-apart stud members having a plurality of blocks positioned between adjacent stud members and bonded together into an integral wall or roof structure by a means positioned around alternate stud members. In specific embodiments thereof, the basic building structure may be modified so as to support floor, ceiling or roof joists as may be desired, and/or comprise blocks of insulating material whereby the building structure of the invention provides an insulated wall or roof structure having better insulating properties than wall and roof structures of conventional designs.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DESCRIPTION OF A PREFERRED EMBODIMENT

Figure 1:
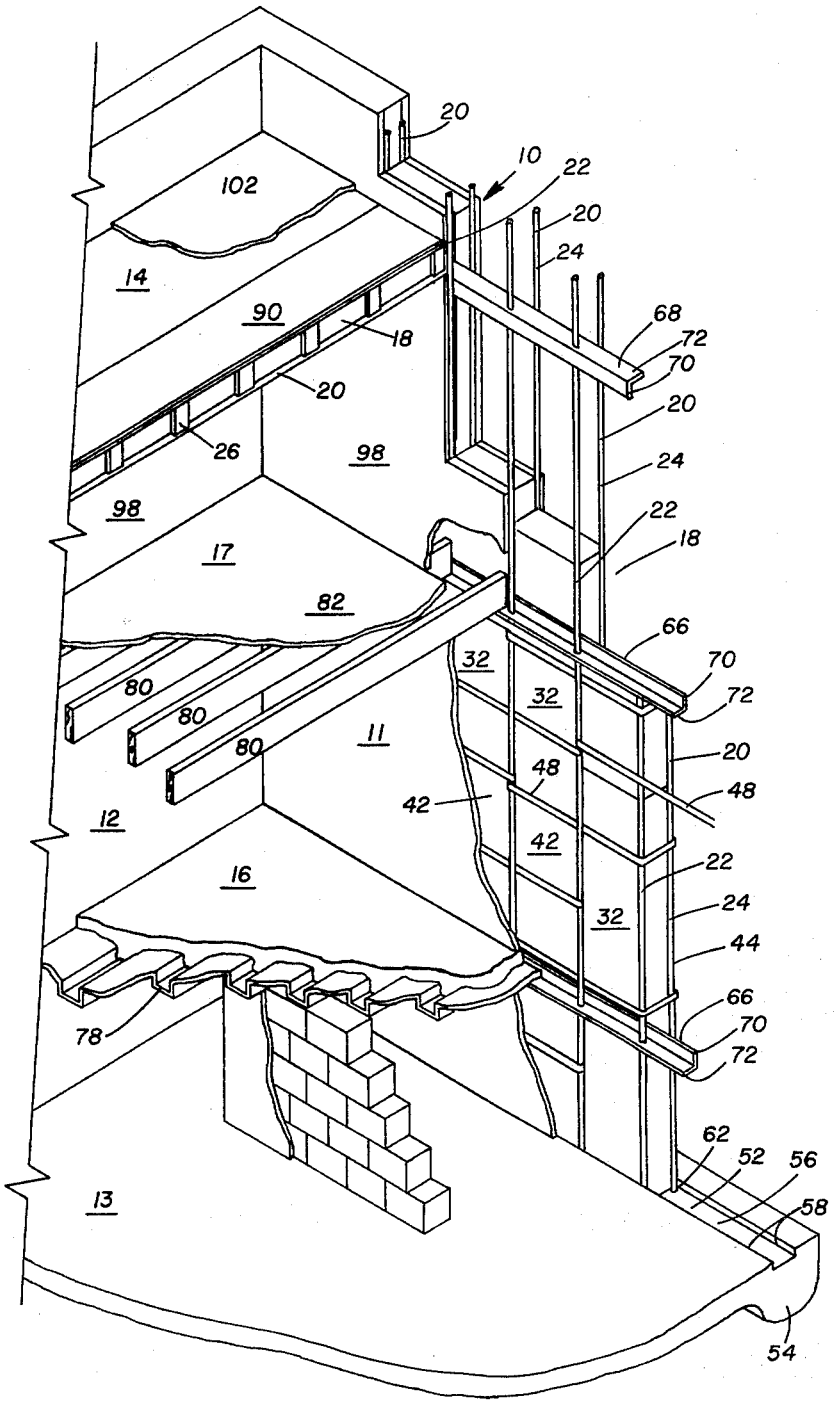
FIG. 1 is a fragmentary, perspective, interior view of a corner portion of a building shell comprised of an integrally poured concrete floor and footing, two intersecting walls, two floors of differing construction, and a roof illustrating the improved building structure of the invention.

Referring to FIG. 1, a building shell 10 is illustrated showing two intersecting wall structures 11, 12 and a roof structure 14 of the improved building structure of the invention secured to an integrally poured concrete floor and footing 13. The building shell 10 is also shown having floors 16 and 17 extending between the walls 11 and 12. The wall structures 11 and 12 and the roof structure 14 generally comprise the basic building structure 18 illustrated in FIG. 2. Inasmuch as many of the elements of the building structure 18 are the same, like reference numerals will be used herein to indicate like structure.

Figure 2A:
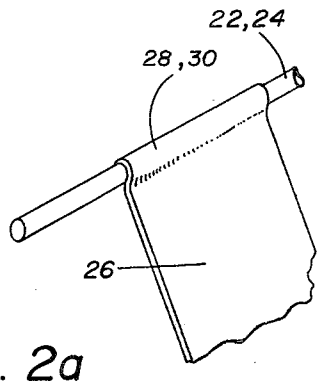
FIG. 2*a* is a perspective and fragmentary view of one of the studs of the basic building structure illustrated in FIG. 2 showing an alternate method of construction.
Figure 2:
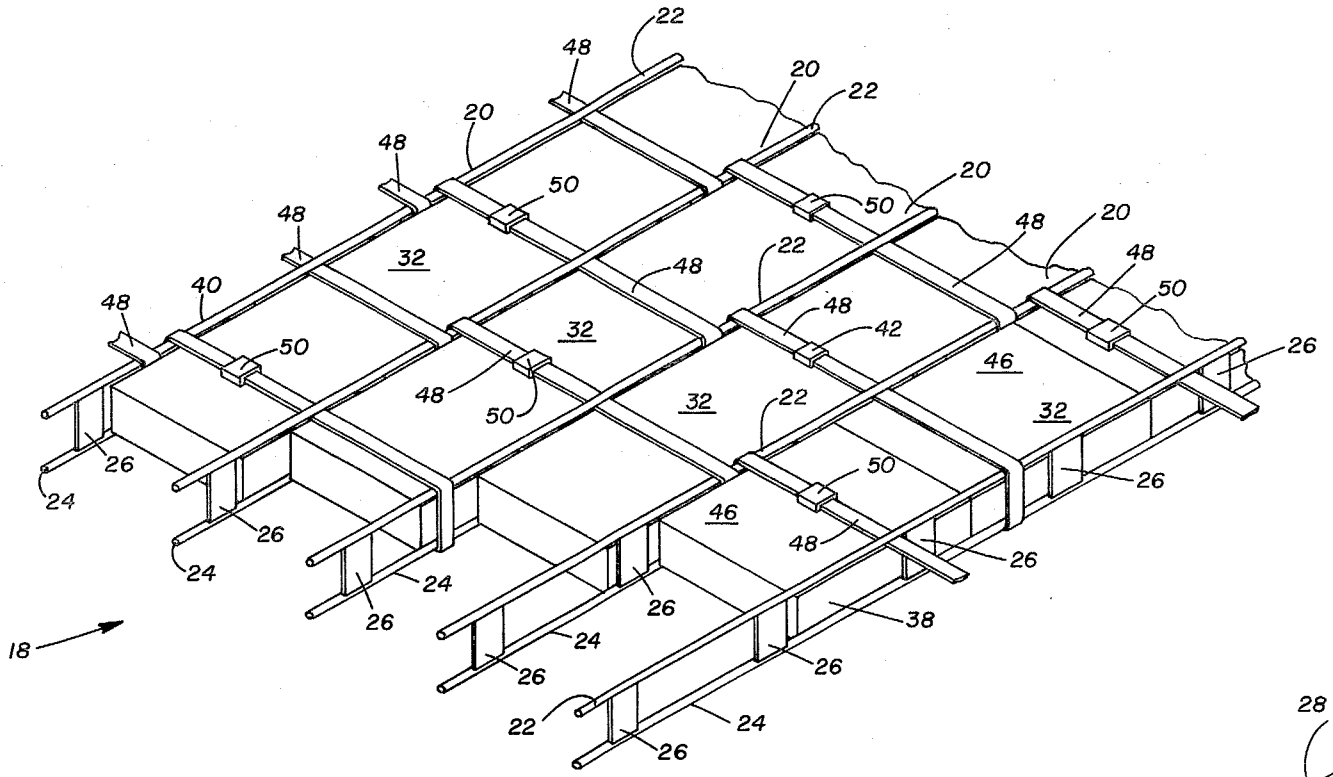
FIG. 2 is a fragmentary and perspective view of the basic building structure of the invention having the surface coating thereof removed so as to illustrate the interior lattice assembly thereof.

Referring to FIG. 2, the building structure 18 is shown to comprise a plurality of spaced-apart and generally parallel stud members 20. As used herein, the word "stud" also includes roof joists, as will become apparent hereinafter. Each of the stud members 20 comprises spaced-apart and generally parallel rod members 22, 24 connected together by a plurality of spacers 26. The distance between the rod members 22 and 24 is generally the same as but, but less than the thickness of the intended wall structure 11, 12 or roof structure 14. One end 28 of each spacer 26 is attached to rod member 22, and the other end 30 of each spacer 26 is attached to rod member 24. In the specific embodiment illustrated in FIG. 2, spacers 26 are attached to rod members 22 and 24 by conventional welding. As illustrated in FIG. 2*a*, the opposite ends of the spacers 26 may also be attached to rod members 22 and 24 by crimping the same around the rod members 22 and 24. This later alternate construction allows for the studs 20 to be easily assembled when needed at the site.

An interstitial column 32 is positioned between each pair of adjacent stud members 20. In a flat wall or roof structure, interstitial columns 32 are of a rectangular shape and have opposite top 34 and bottom 36 end surfaces, opposite edge surfaces 38, 40, and opposite interior 42 and exterior 44 side surfaces. The distance between edge surfaces 38, 40 (the width of columns 32) determines the spacing between the stud members 20. The distance between the interior and exterior surfaces 42 and 44 (the thickness of columns 32) is generally equal to but slightly less than the widths of studs 20. In the specific embodiment illustrated, interstitial columns 32 each have a thickness of about two inches less than the distance between rod members 22, 24 and a width equal to the desired spacing of studs 20. As illustrated, each of the interstitial columns 28 may be comprised of a plurality of interstitial blocks 46 stacked in an edge to edge relationship.

Thus, a stud member 20 is positioned between adjacent edge surfaces 38 and 40 of each adjacent pair of interstitial columns 32. Also, a stud member 20 is positioned adjacent the oppositely facing surfaces 38 and 40 of the most remote interstitial columns 32.

In a curved wall structure, interstitial columns 32 may be annular segments rather than being rectangular in shape. The words "rectangular columns" and "rectangular blocks" are used herein to include columns and blocks in the shape of annular segments. Otherwise a curved wall structure has the same structure as a flat wall structure.

Figure 8:
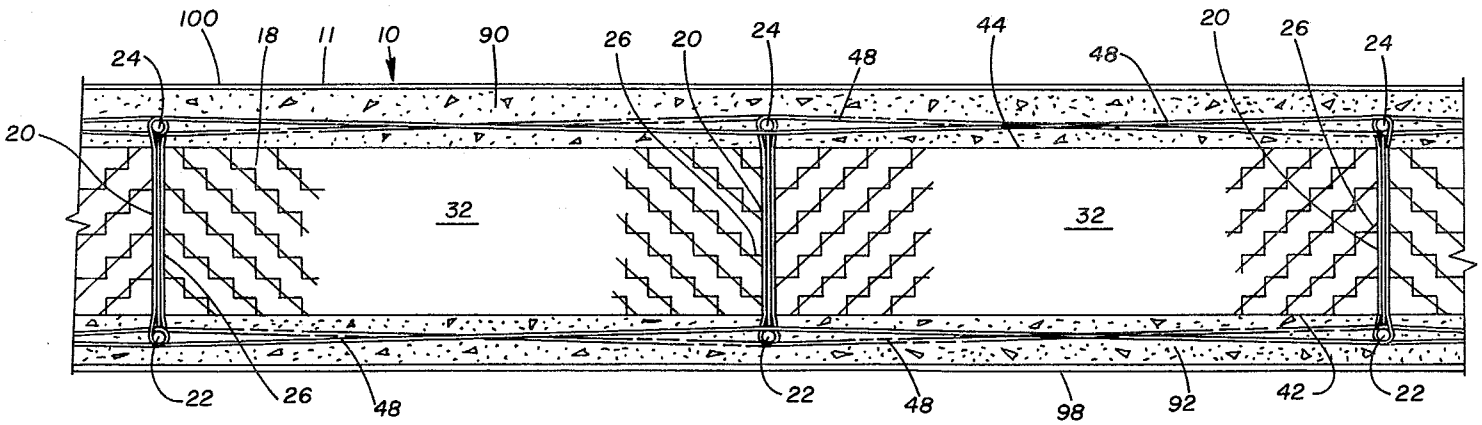
FIG. 8 is a fragmentary and cross-sectional view of the wall structure illustrated in FIGS. 3, 4 and 5 in a transverse direction.

The alternating studs 20 and interstitial columns 32 are bound together into an integral wall bearing wall or roof structure by a plurality of straps 48. Each of the straps 48 is placed around alternate studs 20 so as to encompass the alternate studs 20 and the two interstitial columns 32 therebetween. While the straps 48 encompass each of the alternate studs 20, the straps 48 pass between the rods 22, 24 of the mediate stud 20. See FIG. 8.

The straps 48 are tightened to a sufficient tension to hold the entire structure 18 together into an integral wall or roof structure as above-mentioned. Each of the straps 48 are provided with a fastener 50 which secures together the opposite ends thereof. In a specific embodiment, the straps 48 and the fasteners 50 may be conventional metal strapping such as is used in crating large machinery.

In specific embodiments, the number of columns 32 and studs 20 will vary depending upon the design characteristics of the building shell 10. As with conventional building structures, the spacing of the studs 20 will vary depending upon building codes, the load carried by the wall structure, or the span of the roof structure. Also, the number of interstitial columns 32, stud members 20 and straps 48 will vary upon the size of the basic building shell 10.

Figure 3A:
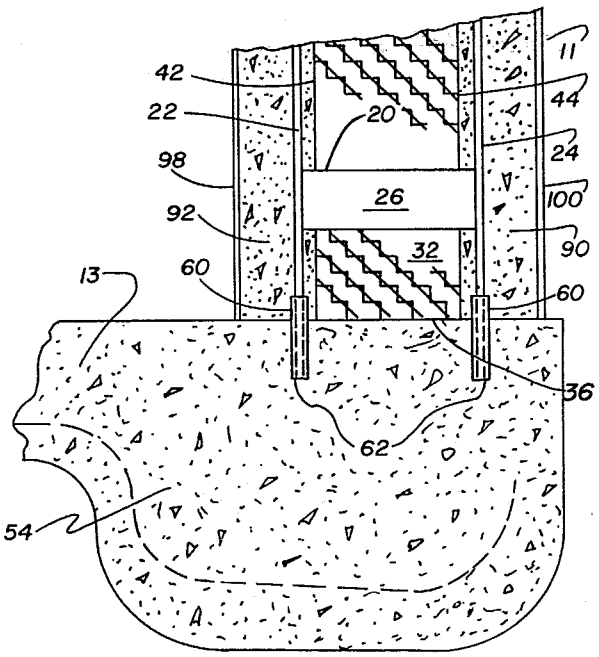
FIG. 3*a* is a view similar to FIG. 3 showing an alternate construction.
Figure 3:
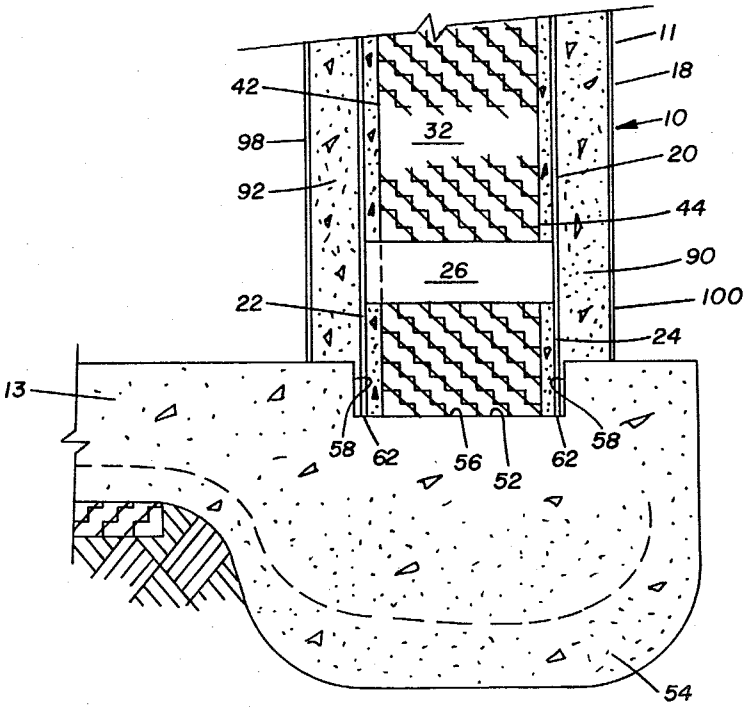
FIG. 3 is a fragmentary and cross-sectional view of an exterior wall of the improved building structure of the invention and the integrally poured concrete floor and footing illustrated in FIG. 1 showing the connection therebetween.
Figure 7:
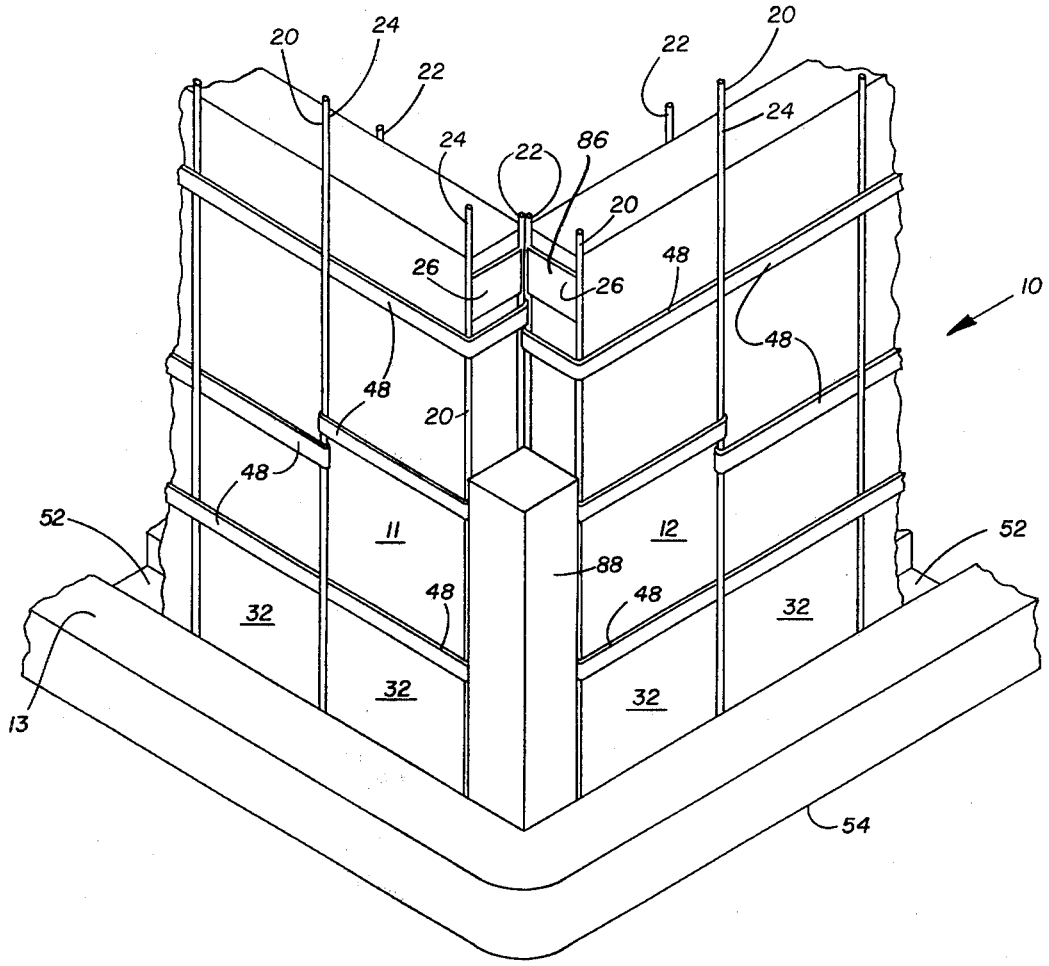
FIG. 7 is a fragmentary and perspective view of an exterior corner portion of the building shell illustrated in FIG. 1.

Referring now to FIGS. 1, 3 and 7, the erection of the wall structures 11, 12 and the connection thereof to the integral concrete floor and footing 13 will now be described. As shown in both FIGS. 1 and 3, wall structures 11 and 12 upstand from the integral floor and footing 13. In the specific embodiment illustrated in FIGS. 1 and 3, a channel 52 is formed in the top surface of the floor and footing 13 directly above the footing portion 54. Channel 52 extends around the periphery of the floor and footing 13 and is formed by suitable forms as the floor and footing 13 is poured in a conventional manner. Channel 52 has a bottom 56 and upstanding sides 58. The distance between the upstanding sides 58 is sufficient such that the studs 20 can be positioned within channel 52 as shown.

FIG. 3*a* illustrates an alternate method of connecting the studs 20 to the floor and footing 13. In this specific embodiment, parallel and spaced apart tubes 60 are partially embedded in the floor and footing 13 directly above the footing portion 54 thereof so as to receive the bottom ends 62 of the rods 22 and 24 of a stud 20. A pair of tubes 60 is provided for each of the studs 20. Care must be taken to maintain the tubes 60 in the appropriate spaced-apart and parallel relationship such that the studs 20 can be attached thereto. A tube-positioning jig (not shown) is used during the pouring of the floor and footing 13 for this purpose.

As the walls 11 and 12 are erected, each of the studs 20 are either positioned in the channel 52 or on the tubes 60 so as to upstand from floor and footing 13. Interstitial columns 32 are positioned therebetween and the straps 48 are positioned around alternate studs 20 as above described and secured. The walls 11 and 12 are so constructed from the ground up to the height desired. While every effort is made for the interior surfaces 42 of columns 32 of walls 11, 12 to intersect at right angles, exterior surfaces 44 do not. See FIG. 7.

In a specific embodiment, as heretofore mentioned, columns 32 comprise a plurality of blocks 46 stacked in an edge to edge relationship. Similarly, studs 20 are provided in manageable lengths. Inasmuch as studs 20 extend the entire height of the building shell 10, studs 20 may have to be connected in an end to end relationship to provide a continuous stud of the length desired. This is achieved by tubular connectors 64. See FIGS. 4, 5 and 6.

Figure 4:
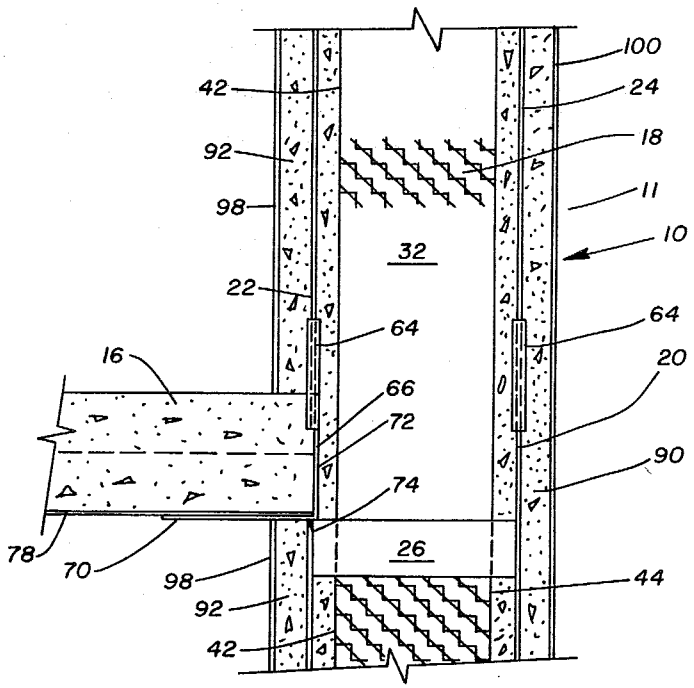
FIG. 4 is a fragmentary and cross-sectional view of the improved wall structure of the invention showing the connection thereto of one of the floor constructions illustrated in FIG. 1.
Figure 5:
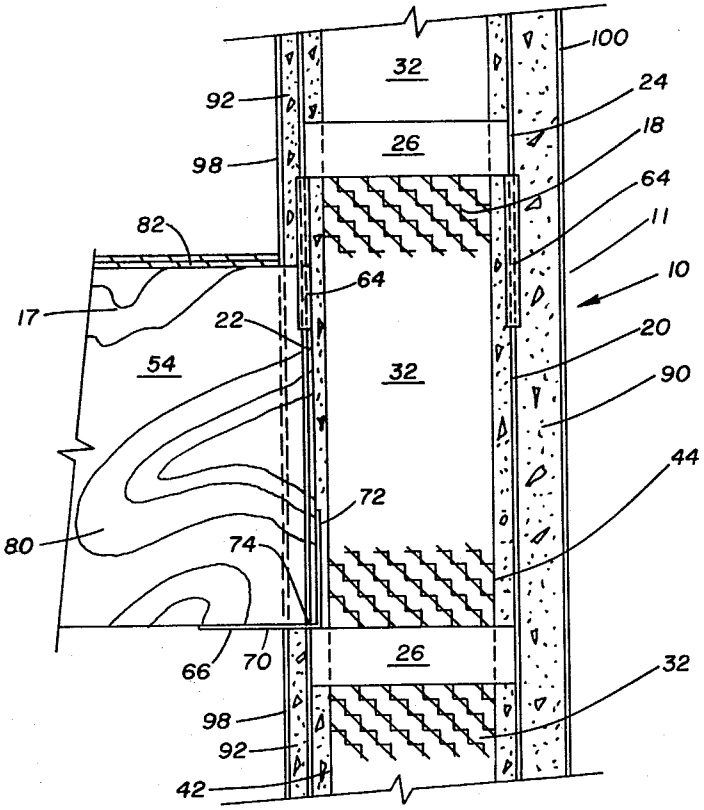
FIG. 5 is a fragmentary and cross-sectional view of the improved wall structure of the invention showing the connection thereto of the other floor construction illustrated in FIG. 1.

As the walls 11 and 12 are being constructed, floor 66 and roof 68 supports are assembled on the studs 20. As shown in FIGS. 4 and 5, each of the floor supports 66 in the specific embodiment illustrated are angle irons having opposite flanges 70 and 72 positioned at right angles to each other. The horizontal flange 70 of each floor support 66 has a plurality of spaced-apart holes 74 or apertures therein so as to receive rods 22 of studs 20. As is apparent from both FIGS. 5 and 6, floor supports 66 are assembled on the studs 20 by positioning the support 66 over the distal ends 76 of the rods 22, aligning the rods 22 with the apertures 74 in the flange 70, and lowering the support on to the rods until supports 66 rest on the spacers 26. The spacers 26 of each of the studs 20 upon which the supports 66 rest must be positioned at the same elevation and at the elevation desired for each of the floor supports. The remaining spacers 26 can be randomly positioned as desired. In a specific embodiment, spacers 26 are positioned at the same distance from each end thereof such that all of the spacers 26 are at the same elevation. With the floor supports 66 so positioned each floor support is supported by a plurality of spacers 26 against downward movement, and against counterclockwise rotation in response to the weight borne by the flange 72 by the engagement of the rods 22 with flange 64.

As shown in FIG. 1, two different floor constructions are illustrated. Floor 16 basically comprises a corrugated steel integral joist or deck 78 extending between the floor supports 66 of wall structures 11 and 12 at the same level and the floor supports 66 in the opposite wall structures (not shown). Concrete is then poured on the steel deck 78 and finished in a conventional manner.

Floor 17 is constructed in a more conventional manner having floor joists 80 extending from the floor support 66 of wall structure 12 to the floor support in the opposite wall (not shown). As shown each of the floor joists 80 extend in a spaced-apart and generally parallel manner. The most remote floor joists 80 are supported by floor supports 66 in the wall structure 11 and the wall opposite (not shown). Conventional ply-wood subflooring 82 and conventional flooring (not shown) is applied over the floor joists as desired.

Figure 6:
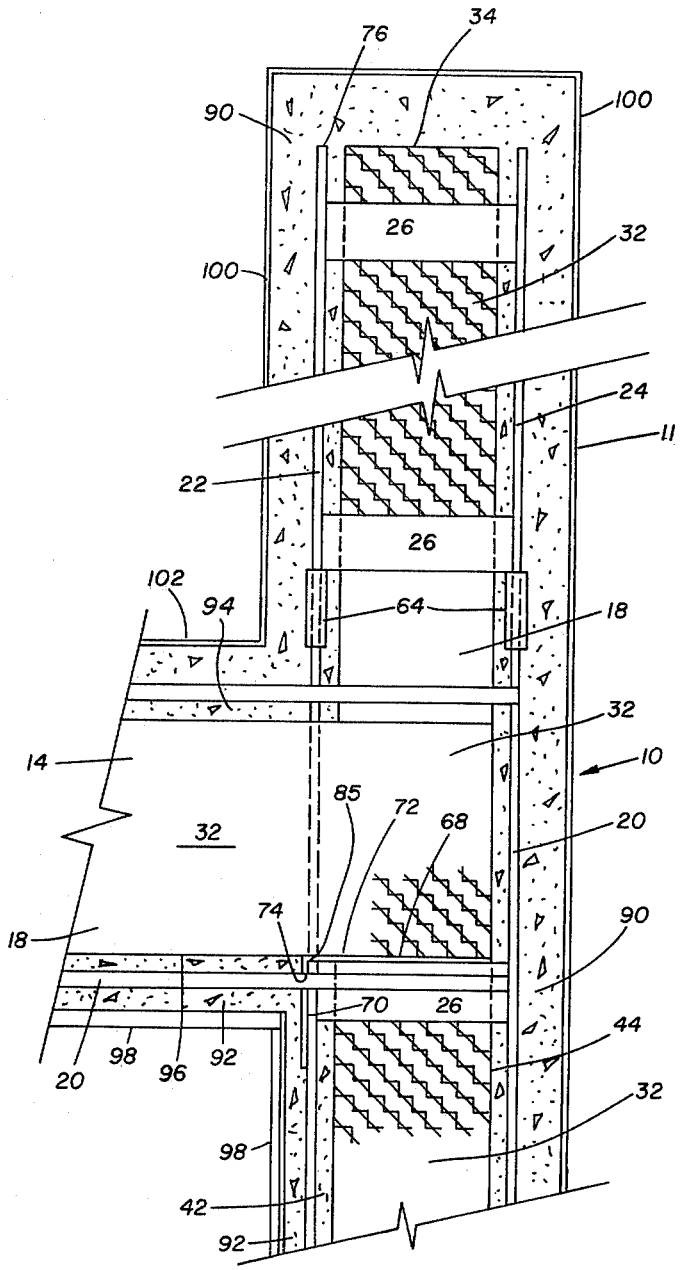
FIG. 6 is a fragmentary and cross-sectional view of the improved wall structure of the invention showing the connection thereto of the roof structure illustrated in FIG. 1.

Referring to FIG. 6, the roof structure 14 will now be described in detail. As mentioned hereinabove, the roof structure 14 comprises the building structure 18. The building structure 18 is supported by the wall structures 11 and 12 and the oppositely facing wall structures (not shown). Each of the wall structures has a roof support 68. Like the floor supports 66, roof supports 68 in the specific embodiment illustrated are angle irons having right angled flanges 70, 72, roof support flange 72 is positioned so as to overlay the spacers 26 rather than to extend inwardly from the wall structure. See FIG. 6. Thus, flange 72 is fully supported by the spacers 26 and the flange 70 overlays the rods 22 of the studs 20. In addition to the openings 74 in flange 70, flange 72 is provided with a plurality of spaced-apart apertures 85. Rods 22 of the studs are positioned in apertures 85. The columns 32 of building structure 18 of the roof structure 14 rest upon the flanges 72 of the roof supports 84. The rods 22 of the roof structure 14 pass through apertures 74 in the flange 70 as shown. Furthermore, roof structure 14 differs from the wall structures 11 and 12 inasmuch as the rods 22 and 24 are of heavier gauge material. Compare FIG. 6 with FIGS. 4 and 5.

Now referring to FIG. 7, the exterior corners must be completed. As shown, wall structures 11 and 12 define in each corner a space 86 extending the entire height of wall structures 11 and 12. This space 86 is generally rectangular in shape having a square cross-section of a size generally equal to the width of the wall sections 11 and 12. The length of the rectangular space is the height of the wall sections 11 and 12. Also as shown in FIG. 7, a column 88 of the same general shape as the space 86 above described is placed in the space 86 so as to fill the space and form the corner of the building shell 10. Column 88 in a specific embodiment are made from the same material as columns 32 and are secured to the columns 32 by adhesive, pins driven through the columns 88 and into the columns 32 or the like. Various methods of attaching columns 88 to the adjacent columns 32 are acceptable inasmuch as column 88 is not load bearing.

As above described, the building shell 10 is complete except for exterior 90 and interior 92 surface coatings on walls 11, 12, and exterior 94 and interior 96 surface coatings on roof structure 14. As shown in all of the drawings, a surface coating is applied over both surfaces 42 and 44 of the columns 32 of the building structure 18 of the wall structures 11, 12 and roof structure 14. This coating surrounds the rods 22, 24 of each stud 20 and portions of straps 48. In a specific embodiment, this surface coating can be a conventional building material such as concrete, plaster or the like. Other plastic and hardenable materials can be used. In a specific embodiment in which concrete is used, concrete is sprayed onto the surfaces 42, 44 of walls 11, 12 to the desired thickness by applying multiple layers. This same surface coating can be used on the surfaces 42, 44 of roof structure 14. The concrete having the stud rods 22, 24 and portions of the straps embedded therein provides a wall 11, 12 or roof 14 structure capable of bearing considerable loads. As shown in FIG. 6, the surface coating 90 can also be used to cap the top of wall structures 11 and 12. Conventional paint, wall board, paneling or the like 98 can then be applied to the interior surface coating 96 and 92 of the roof structure 14 and the wall structures 11 and 12. Similarly, paint, or other weather protective coatings 100 can be applied to the exterior coating 92 of the wall structures 11 and 12. Tar or other conventional roofing materials 102 can be applied to the exterior surface coating 94 of the roof structure 14.

While the roof structure 14 is shown to form a relatively flat roof, it is well within the scope of those skilled in the art of building construction to utilize wall structures 11 and 12 to support a conventional sloped roof. A conventional sloped roof can be constructed on and supported by wall structures 11 and 12 in any of conventional ways commonly used with masonry wall structures.

In a specific embodiment, columns 32 and columns 88 are both made of polystyrene foamed material. The advantage of this material is that it is relatively available at a reasonable cost. However, other filler materials which can be load bearing to the extent necessary can also be used. In the specific embodiment in which polystyrene foam is utilized, the building structure of the invention provides a wall structure and a roof structure which has better insulating properties than wall and roof structures of conventional design. While all of the plastic foam materials being used in modular building panels can be used, the invention contemplates that these materials would also be provided in block form or column foam and the invention would be constructed on the site as above described. Columns 32 and columns 88 can also comprise hollow boxes of plastic, wood or metal empty or filled with conventional insulating materials. The invention contemplates and the words "block" and "column" and derivatives thereof are used herein to include all of these structures.

Similarly, the invention contemplates various surface materials. While conventional building materials are preferable inasmuch as their characteristics are well known and they are readily available at low cost, other more exotic surface materials such as plastic or the like can also be used.

The improved building structure of the invention provides a building structure having many of the properties of modular building panels, yet retaining many of the advantages of conventional on-site construction. The improved building structure of the invention can be used for both exterior and interior walls and roof structures. The improved building structure of the invention can be used as a load bearing wall.

While there have been described above the principles of this invention in connection with specific apparatus, it is to be clearly understood that this description is made only by way of example and not as a limitation to the scope of the invention.

What is claimed is:

1. A building structure comprising a plurality of spaced-apart stud members, said members defining interstitial spaces therebetween each having a thickness generally equal to the width of said studs, said spaces each having a length generally equal to the length of said studs and a width generally equal to the spacing between said studs, said spaces each being filled with at least one generally rectangular block of self-supporting material thereby defining a column of said material between each adjacent pair of said studs having a shape generally corresponding to said spaces, means extending between alternate studs for connecting said studs and columns together into a load bearing structure, said means includes a plurality of spaced-apart straps positioned around alternate ones of said studs to encompass said alternate studs and one of said studs therebetween and two of said columns between said studs, said straps being taut in tension.

2. The building structure of claim 1 wherein said stud members comprise a pair of spaced-apart and generally parallel rods secured together at spaced-apart intervals by a plurality of spacers.

3. The building structure of claim 1 wherein said material is a heat-insulating material.

4. The building structure of claim 1 wherein said wall or roof structure has applied to the exposed surfaces thereof a surface coating in contact with said columns, said surface coating being a flowable but hardenable material surrounding portions of said studs and connecting means, said stud and connecting means portions reinforcing said surface coating.

5. The building structure of claim 1 further comprising a foundation, means for connecting said studs to said foundation, said studs and said columns upstanding from said foundation thereby forming a wall, said wall having a roof support connected thereto, and a roof resting on said roof support and supported by said wall.

6. The building structure of claim 5 wherein said wall has a bottom, said stud-foundation connecting means comprises a channel formed in said foundation adjacent the periphery thereof, said channel having a bottom and upstanding side walls and being generally complementary to said wall adjacent to said wall bottom, said bottom resting upon said channel bottom, said wall being between said channel side walls.

7. The building structure of claim 5 wherein said roof comprises a plurality of spaced-apart stud members, said stud members defining interstitial spaces therebetween each having a thickness generally equal to the width of said studs, said spaces each having a length generally equal to the length of said studs and a width generally equal to the spacing between said studs, said spaces each being filled with one or more generally rectangular blocks of self-supporting material thereby defining a column of said material between said adjacent pair of said studs having a shape generally corresponding to said spaces, means extending between alternate studs for connecting said studs and columns together into a load bearing roof structure.

8. The building structure of claim 5 further comprising at least one floor support connected to said wall, a floor, said floor having a peripheral portion, said peripheral portion resting on said floor support.

9. A building structure comprising a plurality of spaced-apart stud members, said stud members defining interstitial spaces therebetween each having a thickness generally equal to the width of said studs, said spaces each having a length generally equal to the length of said studs and a width generally equal to the spacing between said studs, said spaces each being filled with at least one generally rectangular block of self-supporting material thereby defining a column of said material between each adjacent pair of said studs having a shape generally corresponding to said spaces, means extending between alternate studs for connecting said studs and columns together into a load bearing structure, said wall or roof structure has applied to the exposed surfaces thereof a surface coating, said surface coating being a flowable but hardenable material surrounding portions of said studs and connecting menas, said stud members comprise a pair of spaced-apart and generally parallel rods secured together at spaced-apart intervals by a plurality of spacers, said means includes a plurality of spaced-apart straps positioned around alternate ones of said studs to encompass said alternate studs and one of said studs therebetween and two of said columns between said studs, said straps being taut and in tension, said material is heat-insulating material.

10. The building structure of claim 9 wherein each of said stud spacers have opposite ends, said spacer ends being crimped around said rods thereby securing said rods and spacers together into a load-bearing stud.

11. A building structure comprising a plurality of spaced-apart stud members, said stud members defining interstitial spaces therebetween each having a thickness generally equal to the width of said studs, said spaces each having a length generally equal to the length of said studs and a width generally equal to the spacing between said studs, said spaces each being filled with at least one generally rectangular block of self-supporting material thereby defining a column of said material between each adjacent pair of said studs having a shape generally corresponding to said spaces, means extending between alternate studs for connecting said studs and columns together into a load bearing structure, a foundation, means for connecting said studs to said foundation, said studs and said columns upstanding from said foundation thereby forming a wall, said wall having a roof support connected thereto, and a roof resting on said roof support and supported by said wall, said stud members comprise a pair of spaced-apart and generally parallel rods secured together at spaced-apart intervals by a plurality of spacers, said stud foundation-connecting means comprises a plurality of tubes partially imbedded in said foundation, said tubes upstanding and extending from said foundation, thereby defining exposed tube ends, said tubes being spaced-apart and parallel to each other, said tubes being arranged in pairs, said tube pairs being spaced the same as said studs, said tubes of each pair being spaced the same as said rods, said rods extending beyond said columns, thereby defining rod ends, said rod ends being positioned in said tubes, there being a tube for each rod end.

12. A building structure comprising a plurality of spaced-apart stud members, said stud members defining interstitial spaces therebetween each having a thickness generally equal to the width of said studs, said spaces each having a length generally equal to the length of said studs and a width generally equal to the spacing between said studs, said spaces each being filled with at least one generally rectangular block of self-supporting material thereby defining a column of said material between each adjacent pair of said studs having a shape generally corresponding to said spaces, means extending between alternate studs for connecting said studs and columns together into a load bearing structure, a foundation, means for connecting said studs to said foundation, said studs and said columns upstanding from said foundation thereby forming a wall, said wall having a roof support connected thereto, and a roof resting on said roof support and supported by said wall, said roof comprises a plurality of spaced-apart stud members, said stud members defining interstitial spaces therebetween each having a thickness generally equal to the width of said studs, said spaces each having a length generally equal to the length of said studs and a width generally equal to the spacing between said studs, said spaces each being filled with one or more generally rectangular blocks of self-supporting material thereby defining a column of said material between each adjacent pair of said studs having a shape generally corresponding to said spaces, means extending between alternate studs for connecting said studs and columns together into a load bearing roof structure, said stud members comprise a pair of spaced-apart and generally parallel rods secured together at spaced-apart intervals by a plurality of spacers, said roof support comprises an angle member having two flanges disposed generally perpendicularly to each other, one of said flanges being supported by and resting on said spacers, the other of said flanges having spaced-apart apertures therein, the spacing of said apertures being generally the same as the spacing of said roof studs, one rod of each of said roof studs being positioned in each of said apertures.

13. The building structure of claim 12 wherein said means includes a plurality of spaced-apart straps positioned around alternate ones of said studs to encompass said alternate studs and one of said studs therebetween and two of said columns between said studs, said straps being taut and in tension, said material is a heat-insulating material, said wall and roof structure has applied to the exposed surfaces thereof a surface coating, said surface coating being a flowable but hardenable material surrounding portions of said studs and connecting means.

14. A building structure comprising a plurality of spaced-apart stud members, said stud members defining interstitial spaces therebetween each having a thickness generally equal to the width of said studs, said spaces each having a length generally equal to the length of said studs and a width generally equal to the spacing between said studs, said spaces each being filled with at least one generally rectangular block of self-supporting material thereby defining a column of said material between each adjacent pair of said studs having a shape generally corresponding to said spaces, means extending between alternate studs for connecting said studs and columns together into a load bearing structure, a foundation, means for connecting said studs to said foundation, said studs and said columns upstanding from said foundation thereby forming a wall, said wall having a roof support connected thereto, and a roof resting on said roof support and supported by said wall, at least one floor support connected to said wall, a floor, said floor having a peripheral portion, said peripheral portion resting on said floor support, said roof comprises a plurality of spaced-apart stud members, said stud members defining interstitial spaces therebetween each having a thickness generally equal to the width of said studs, said spaces each having a length generally equal to the length of said studs and a width generally equal to the spacing between said studs, said spaces each being filled with one or more generally rectangular blocks of self-supporting material thereby defining a column of said material between each adjacent pair of said studs having a shape generally corresponding to said spaces, means extending between alternate studs for connecting said studs and columns together into a load bearing roof structure, said stud members comprise a pair of spaced-apart and generally parallel rods secured together at spaced-apart intervals by a plurality of spacers, said floor support comprises an angle member having two flanges disposed generally perpendicularly to each other, one of said flanges being supported by and resting on said spacers, the other of said flanges having spaced-apart apertures therein, the spacing of said apertures being generally the same as the spacing of said wall studs, one rod of each of said wall studs being positioned in each of said apertures, said roof support comprises an angle member having two flanges disposed generally perpendicularly to each other, one of said flanges being supported by and resting on said spacers, the other of said flanges having spaced-apart roof support apertures therein, the spacing of said roof support apertures being generally the same as the spacing of said roof studs, one rod of each of said roof studs being positioned in each of said roof support apertures.

15. The building structure of claim 14 wherein said means includes a plurality of spaced-apart straps positioned around alternate ones of said studs to encompass said alternate studs and one of said studs therebetween and two of said columns between said studs, said straps being taut and in tension, said material is a heat-insulating material, said wall and roof structure has applied to the exposed surfaces thereof a surface coating, said surface coating, being a flowable but hardenable material surrounding portions of said studs and connecting means.

16. The method of construction comprising providing a plurality of spaced-apart studs, placing blocks of self-supporting material between each adjacent pair of studs, thereby forming a composite structure of alternating studs and blocks bounded by the two most remote studs, said blocks having a thickness generally equal to the width of said studs, said blocks having a width generally equal to the desired spacing between said studs and a length generally equal to the length of said studs, and binding said composite structure together by urging said studs together, applying to the exposed surfaces of said composite structure a flowable surface coating material in contact with said columns, surrounding said stud rods with said material, and hardening said material, said providing step includes providing a plurality of rods, dividing said rods into pairs, placing said rods of each of said pairs in a spaced-apart and parallel relation to the other rod of said pair, positioning a plurality of rigid spacers of essentially the same length between said rods of each pair at spaced-apart intervals, and securing said rods of each pair together by securing said rods to the opposite ends of said spacers, said securing step includes crimping the opposite ends of each of said spacer around said rods of one of said pairs.

17. The method of construction comprising providing a plurality of spaced-apart studs, placing blocks of self-supporting material between each adjacent pair of studs, thereby forming a composite structure of alternating studs and blocks bounded by the two most remote studs, said blocks having a thickness generally equal to the width of said studs, said blocks having a width generally equal to the desired spacing between said studs and a length generally equal to the length of said studs, and binding said composite structure together by urging said studs together, applying to the exposed surfaces of said composite structure a flowable surface coating material in contact with said columns, surrounding said stud rods with said material, and hardening said material, said binding step includes positioning a plurality of spaced-apart straps around alternate ones of said studs to encompass said alternate studs and said blocks and mediate stud therebetween, tightening said straps and fastening said straps in tension.

18. The method of claim 17 further comprising providing a foundation, placing said composite structure on said foundation with said studs upstanding therefrom, attaching to said studs a roof support, providing a roof having peripheral portions, and resting one of said peripheral portions on said roof support.

19. The method of claim 18 wherein said roof providing step includes providing a plurality of spaced-apart roof studs, placing blocks of self-supporting material between each adjacent pair of roof studs, thereby forming a composite roof structure of alternating roof studs and blocks bounded by the two most remote roof studs, said blocks having a thickness generally equal to the width of said roof studs, said blocks having a width generally equal to the desired spacing between said roof studs and a length generally equal to the length of said roof studs, and binding said composite roof structure together by urging said roof studs together.

20. The method of claim 19 wherein said stud providing step includes providing a plurality of rods dividing said rods into pairs, placing said rods of each of said pair in a spaced-apart and parallel relation to the other rod of said pair, positioning a plurality of rigid spacers of essentially the same length between said rods of each pair at spaced-apart intervals, and securing said rods of each pair together by securing said rods to the opposite ends of said spacers, said roof structure binding step includes positioning a plurality of spaced-apart straps around alternate ones of said studs to encompass said alternate studs and said blocks and mediate stud therebetween, tightening said straps and fastening said straps in tension, and said attaching step includes providing a roof support in the form of an angle member having two flanges generally disposed perpendicularly to each other, forming in each of said flanges a plurality of spaced-apart holes, laying one of said flanges on said spacers, and positioning one of said rods of each of said studs in the holes of said one flange positioning one of said rods of each of said roof studs in the holes of said other flange.

21. The method of claim 17 further comprising providing a foundation, placing said composite structure on said foundation with said studs upstanding therefrom, attaching to said studs a floor support, providing a floor having peripheral portions, and resting one of said peripheral portions on said floor support.

22. The method of claim 21 wherein said floor support attaching step includes providing a floor support in the form of an angle member having two flanges disposed generally perpendicularly to each other, forming in one of said flanges a plurality of spaced-apart holes, positioning one of said rods of each of said studs in said holes and the other of said flanges to overlie said one rod, and positioning said one flange to extend inwardly of said wall, said one flange engaging said one peripheral floor portion and supporting said floor.

23. The method of claim 22 further comprising providing a plurality of spaced-apart roof studs, placing blocks of self-supporting material between each adjacent pair of roof studs, thereby forming a composite roof structure of alternating roof studs and blocks bounded by the two most remote roof studs, said blocks having a thickness generally equal to the width of said roof studs, said blocks having a width generally equal to the desired spacing between said roof studs and a length generally equal to the length of said roof studs, and binding said composite roof structure together by urging said roof studs together, providing a roof support in the form of an angle member having two flanges generally disposed perpendicularly to each other, forming in each of said flanges a plurality of spaced-apart holes, laying one of said flanges on said spacers, and positioning one of said rods of each of said roof studs in the holes of said one flange, said roof stud providing step includes providing a plurality of rods dividing said rods into pairs, placing said rods of each of said pair in a spaced-apart and parallel relation to the other rod of said pair, positioning a plurality of rigid spacers of essentially the same length between said rods of each pair at spaced-apart intervals, and securing said rods of each pair together by securing said rods to the opposite ends of said spacers, said roof structure binding step includes positioning a plurality of spaced-apart straps around alternate ones of said studs to encompass said alternate studs and said blocks and mediate stud therebetween, tightening said straps and fastening said straps in tension.

* * * * *